United States Patent [19]

Bullock, Jr. et al.

[11] 4,038,127

[45] July 26, 1977

[54] APPARATUS FOR CONTROLLING THE ANGULAR ORIENTATION OF THE END OF A ROLLED WEB

[75] Inventors: Richard H. D. Bullock, Jr., Media; George Gallatig, West Chester, both of Pa.; Kurtz A. Franklin, Burlington, N.J.

[73] Assignee: Scott Paper Company, Philadelphia, Pa.

[21] Appl. No.: 730,711

[22] Filed: Oct. 8, 1976

[51] Int. Cl.[2] ..... B26D 5/00

[52] U.S. Cl. ..... 156/353; 156/361; 156/446; 242/56 R

[58] Field of Search ..... 156/353, 361, 360, 378, 156/368, 187, 450, 446; 242/56 R, 56 A, 56 B, 67.1 R, 67.2, 57, 186; 235/92 CW, 151 R

[56] References Cited

U.S. PATENT DOCUMENTS

| | | | |
|---|---|---|---|
| 3,123,315 | 3/1964 | Couzens | 242/56 R |
| 3,282,524 | 11/1966 | Couzens et al. | 242/56 R |
| 3,477,657 | 11/1969 | Norbisrath | 242/56 R |
| 3,567,145 | 3/1971 | Ernoult | 242/56 A |

*Primary Examiner*—David A. Simmons

*Attorney, Agent, or Firm*—Joseph H. Yamaoka; William J. Foley

[57] ABSTRACT

An apparatus for accurately positioning the end of a web being wound on a roll at a predetermined angle of the roll. An operator sets up in thumbwheel switches a predetermined number representing the additional angular rotation of the roll after the web has been cut at a winding station in order to have the tail of the roll located at a desired predetermined angle at a second station. As the roll is wound, a sensor responds to an index that rotates in synchronism with the roll to provide a signal indicating that the roll is oriented at a known reference angle. A first pulse source generates pulses wherein each pulse represents a known angle of rotation of the roll as the web is being wound on the core. An electronic counter counts the number of pulses generated by the first pulse source between the occurrence of the signal indicating that the web has been cut and the reference angle signal generated by the winding station sensor. The number of pulses counted by the counter is combined with the predetermined number set up in the thumbwheel switches to generate a second control number representing the further angular rotation of the roll as measured from the reference angle in order to have the tail oriented at the desired predetermined angle. A sensor associated with the second location responds to the index to generate a signal indicating that the roll is at the reference angle when it is at the second station. A second pulse source generates pulses wherein each pulse represents a fixed angle of rotation of the roll at the second station. A counter counts the number of pulses generated by the second pulse source after the occurrence of a signal from the second station sensor. When the number in the counter is equal to the second control number, the roll will be prevented from further rotation and the end of the web will be at the desired angle.

48 Claims, 5 Drawing Figures

APPARATUS FOR CONTROLLING THE ANGULAR ORIENTATION OF THE END OF A ROLLED WEB

BACKGROUND OF THE INVENTION

This invention relates to an apparatus for locating the end, or tail, of a rolled wound product, and in particular to an apparatus that includes a counter, referenced to the cutting of the web, for keeping track of the tail during subsequent operations on the roll.

It is common for manufacturers of rolled products, such as toilet tissue and other fibrous webs, to secure the tail of the wound roll to the roll. If the tail of the roll is not secured to the roll it may hinder the subsequent processing of the roll or may present an unacceptable appearance when packaged in a transparent wrapper. In the manufacture of a toilet tissue product, it is also desirable to secure the tail of the roll to the roll so that about ¾ of an inch of the tail remains free of the roll to provide what is known in the art as a handle which can be grasped by the user to initiate unwinding of the roll. From the above discussion it can be seen that it is desirable to accurately position the tail of the wound roll prior to securing the tail to the roll.

One typical approach for locating and positioning the tail of a rolled product uses a light source and a photocell as disclosed in U.S. Pat. Nos. 3,044,532-Ghisoni and 3,912,571-Hartbauer et al. In those patents, the wound roll is rotated at the tail securing station and a jet of air directed onto the roll deflects the tail of the web into the light ray path between the light source and the photocell. Since the roll is rotating so as to wind the tail back onto the roll, the tail will clear the light ray path causing the photocell to provide an output signal that accurately locates the tail. The photocell output signal controls the tail securing device which could, for example, be a glue applicator. The glue applicator is so located that the tail will be glued to the roll with the desired handle length. One disadvantage of a tail locating apparatus that employs a light source and a photocell is that the response characteristic of the tail locating system is adversely affected by the buildup of fiber particles on the light source and photocell assemblies which can result in an unacceptable tail handle length or prevent entirely the operation of the tail securing device.

It is, therefore, a primary object of this invention to provide an apparatus for locating and positioning the tail of a rolled product being wound onto a core.

Another object of this invention is to provide a more accurate tail locating and positioning apparatus.

And yet another object of this invention is to provide an apparatus that utilizes an electronic counter referenced to the cutting of the web for locating and positioning the tail of a rolled product.

A further object of this invention is to provide an apparatus that uses an electronic counter referenced to the cutting of the web for keeping track of the tail of the roll as it is being wound at a winding station and then uses a number counted by an electronic counter to position the tail at a time that can be unrelated to the cutting of the web.

SUMMARY OF THE INVENTION

In one aspect of this invention, an electronic counter is preset with a number representing the additional angular rotation of the roll after the web has been cut in order to have the tail of the roll located at a desired predetermined angle of the roll. The clock input of the counter is driven from a pulse source wherein each pulse represents a known length of web wound on the roll. Upon receipt of a signal indicating that the web has been cut, the counter is allowed to count down and when the counter reaches zero, the roll is prevented from further rotation thereby positioning the tail at the desired angle.

In another aspect of this invention the tail orienting operation can be performed at a time unrelated to the cutting of the web. In this form of the invention, thumbwheel switches are used to set up a predetermined number representing the additional angular rotation of the roll after the web has been cut in order to have the tail of the roll located at a desired predetermined angle at a stripping location. The apparatus includes an index means that rotates in synchronism with the roll and a sensor at the winding station that responds to the rotating index to provide a signal indicating that the roll is oriented at a known reference angle. A first pulse source generates pulses wherein each pulse represents a known angle of rotation of the roll as the web is being wound on the core. An electronic counter counts the number of pulses generated by the first pulse source between the occurrence of the signal indicating that the web has been cut and the reference angle signal generated by the winding station sensor. The number of pulses counted by the counter is combined with the predetermined number set up in the thumbwheel switches to generate a second control number representing the further angular rotation of the roll as measured from the reference angle in order to have the tail oriented at the desired predetermined angle. A sensor associatd with the stripping location responds to the index means to generate a signal indicating that the core is at the reference angle when it is at the stripping station. A second pulse source generates pulses wherein each pulse represents a fixed angle of rotation of the roll at the stripping station. A counter counts the number of pulses generated by the second pulse source after the occurrence of a signal from the stripping station sensor. When the number in the counter is equal to the second control number, the roll will be prevented from further rotation and the tail of the web will be at the desired angle.

DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

DETAILED DESCRIPTION

Figure 1:
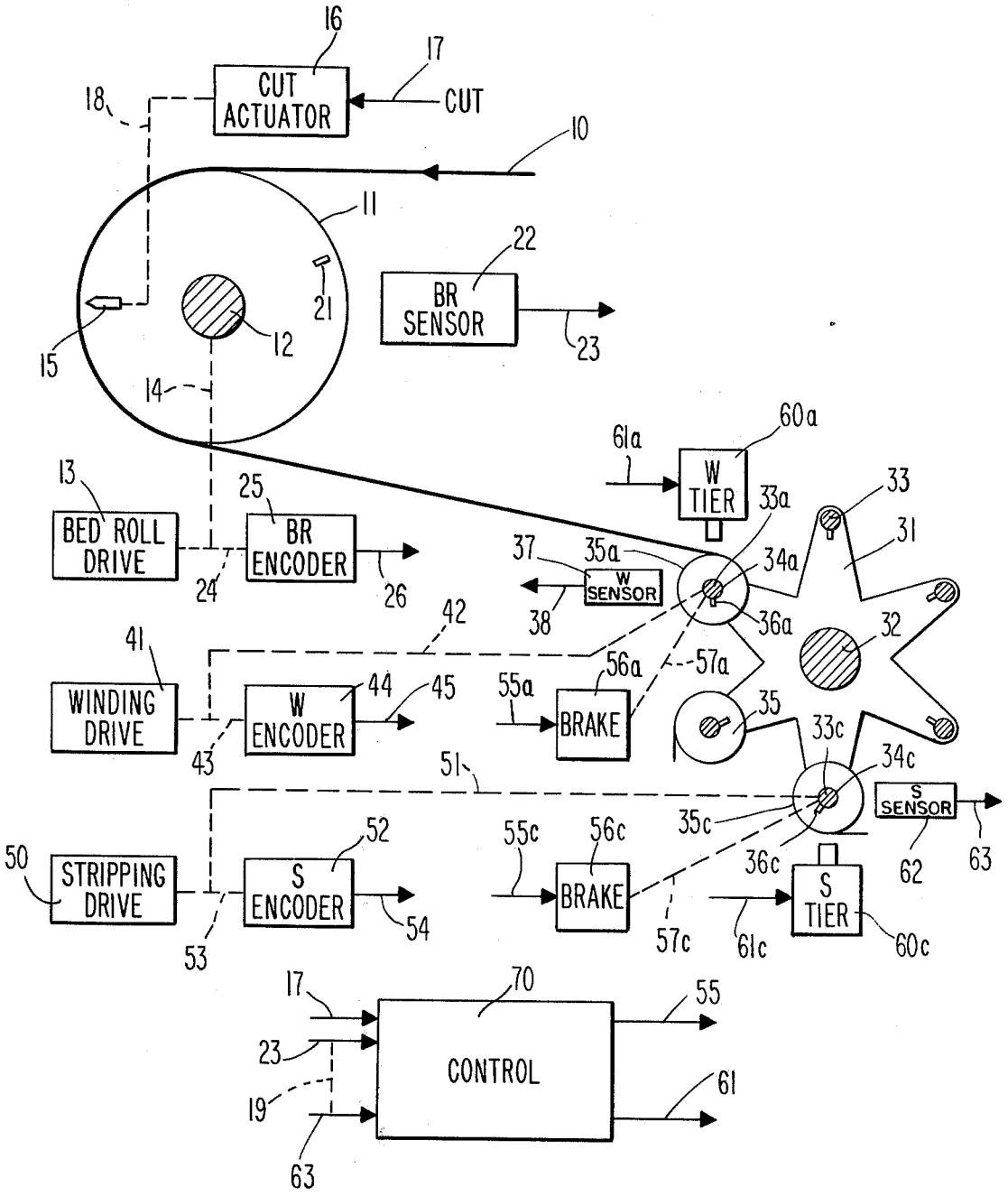
FIG. 1 is a block diagram of a system for winding a web onto a core at a winding station and advancing the wound core to a stripping station where the control apparatus of this invention can orient the tail.

For the sake of convenience, an element depicted in more than one figure will retain the same element number in each figure. Referring now to FIG. 1, a fibrous paper web 10 is wound over the surface of a bedroll 11 onto a core 34*a* mounted on a mandrel 33*a* of a winding machine to build up a roll 35*a* of the paper product. In the typical winding machine, a plurality of winding mandrels 33 are rotatably mounted on the arms of a turret 31 which, in turn, is rotatably supported by a shaft 32. Suitable means (not shown) are provided for rotatably indexing the turret 31 in a clockwise direction in order to bring a succeeding mandrel 33 to the winding station. The mandrel 33*a* at the winding station is rotatably driven by winding drive means 41 as indicated by the dashed line 42. The bedroll 11 is also rotatably supported by a shaft 12 which is rotatably driven by bedroll drive means 13 as indicated by the dashed line 14. When it is determined that the desired length of web has been wound onto the core 34*a*, a CUT signal is applied to the input 17 of a cut actuator 16 which, as indicated by dashed line 18, operates a cutter 15 which severs the web at the periphery of the bedroll surface 11. Upon completion of the winding operation, the turret 31 is indexed in the counterclockwise direction which advances the succeeding mandrel 33, with a fresh core mounted thereon, to the winding station. As the turret 31 is indexed, a wound roll 35 is advanced to a stripping station as indicated by the wound roll 35*c*. At the stripping station, the roll 35*c*, wound on the core 34*c*, is removed from the mandrel 33*c* while a new roll is being wound at the winding station. The mandrel 33*c*, located at the stripping station, is rotatably driven by stripping station drive means 50 as indicated by dashed line 51.

Once a roll of paper 35 has been wound, it is common to secure the free end, or tail, of the web to the roll by means of a tail tier 60. In the system shown in FIG. 1, the tieing function can be accomplished at the winding station by applying the appropriate signal at the input 61*a* of tail tier 60*a*. In another embodiment described herein the tail tier 60*c* is located at the stripping station and can either be activated by applying the appropriate signal at the input 61*c* of tail tier 60*c* or can be automatically operated during the stripping operation as described in U.S. Pat. No. 3,935,057 issued to Robert D. Gray and assigned to the assignee of this invention. Some paper finishing operations require that the tail tieing operation be performed on a roll that is not undergoing rotation. In such systems, there can be located at the stripping location brake means 56*c* which, as indicated by dashed line 57*c*, can prevent further rotation of mandrel 33*c*. The brake 56*c* is activated by applying the appropriate signal at the input 55*c*. If the tail tieing function is performed at the winding station, the brake means 56*a*, as indicated by dashed line 57*a*, prevents further rotation of the mandrel 33*a*.

In order to control the orientation of the wound roll in preparation for the tail tieing function, the various elements of the winding system have been provided with signal generators as now described herein. Associated with the bedroll 11 is an index 21 that rotates in synchronism with the bedroll and which, for example, could be a tooth mounted on the end of the bedroll cylinder. A bedroll sensor 22, operating on electromagnetic principles, generates a pulse at its output 23 as the index 21 rotates past the bedroll sensor 22. A shaft position encoder 25, driven from the bedroll drive means 13 as indicated by dashed line 24, rotates in synchronism with the bedroll 11 and provides at its output 26 a series of pulses wherein each pulse signifies that the bedroll 11 has rotated through a fixed angle. Since the linear velocity of the paper web 10 traveling over the bedroll 11 is approximately the same as the linear velocity of the paper web 10 being wound onto the roll 35*a* (there generally being a slight known differential in order to maintain tension in the web), for a known radius of the roll, each bedroll transducer pulse also can be considered to represent a known incremental angle of rotation of the roll 35*a*. At the instant the web is severed by the blade 15, the roll radius is known and the length of web from the severed end to the roll 35*a* is on the order of 3 convolutions of the roll 35*a*, and since the thickness of the web can be considered negligible, each bedroll transducer pulse also represents a known incremental length of the web being wound onto the roll 35*a*. Of course, it will be appreciated by those skilled in the art that a winding roll shaft position encoder 44 that is driven by the winding drive means 41, as indicated by the dashed line 43 will also provide at its output 45 a series of pulses wherein each pulse represents a known incremental angle of rotation of the roll 35*a*.

In certain of the embodiments later described there is provided an index 36*a* that rotates in synchronism with winding mandrel 33*a* and which, for example, could be a tooth affixed to the mandrel. A sensor 37, associated with the winding station, provides at its output 38 a pulse as the winding index 36*a* rotates past the sensor 37. When the winding sensor 37 pulse occurs, the roll 35*a* is at a known angular position.

In a similar manner a shaft position encoder 52, driven by the strip drive means 50 as indicated by the dashed line 53, generates at its output 54 a series of pulses wherein each pulse represents an incremental angle of rotation of the roll 35*c* at the stripping station. Associated with the mandrel 33*c* is an index 36*c* that rotates in synchronism with mandrel 33*c* and which also could be a tooth affixed to the mandrel 33*c*. A sensor 62 associated with the stripping station generates at its output 63 a pulse when the index 36*c* rotates past the sensor 62 to provide a pulse when the roll 35*c* is at a known angular position.

The means for controlling the orientation of the roll 35 in preparation for the tail tieing function is shown as a single block 70 in FIG. 1 and will be described in detail during the discussion of FIGS. 2, 3 and 4. A control signal at line 55 activates the brake means 56, and a control signal at line 61 controls the activation of the tail tier 60. Inputs to the control block 70 include the CUT signal appearing at line 17, the signal generated by the bedroll sensor 22, appearing at line 23, the signal generated by the strip sensor 62 appearing at line 63, as well as the signals generated by the transducers and other sensors previously described and which are generally represented by the dashed line 19.

Figure 2:
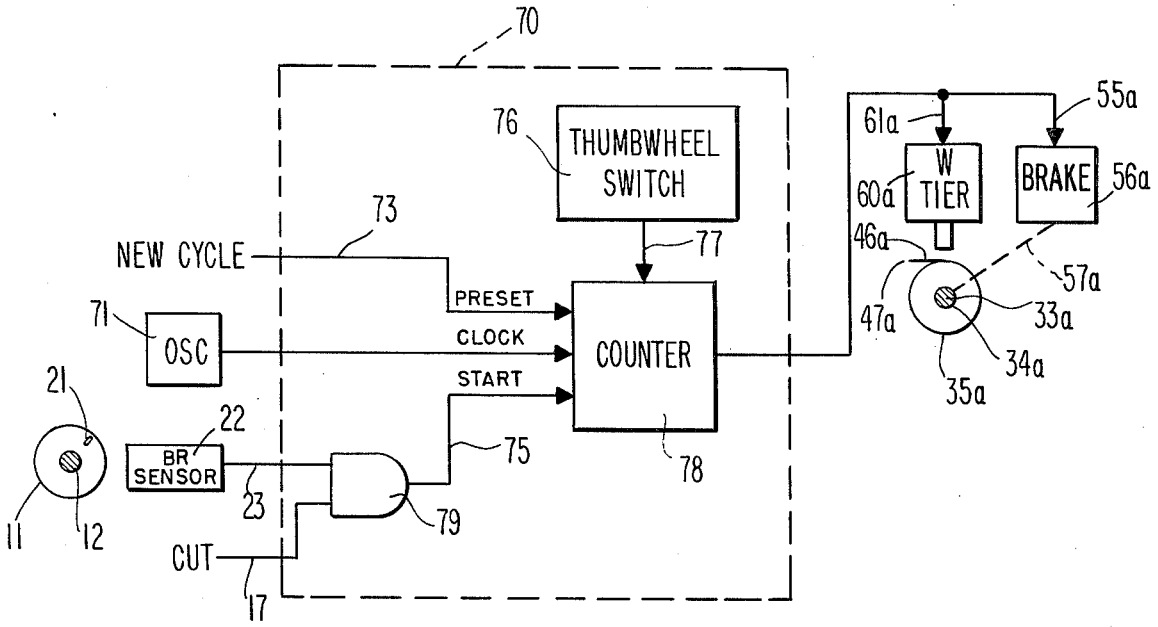
FIG. 2 is a block diagram of one embodiment of the tail orienting control apparatus of this invention.

Referring now to FIG. 2, there is shown one embodiment of an apparatus for keeping track of the tail 47*a* of a web being wound onto a roll 35*a* at a winding station. The control block 70 of FIG. 1 is shown as comprising a plurality of thumbwheel switches 76, a counter 78 and an AND-gate 79. An output signal generated by the counter 78 is applied to inputs 61*a* and 55*a* to activate the tail tier 60*a* and the brake means 56*a*, respectively. Inputs to the control block 70 include the CUT signal, applied to line 17, that indicates that the web is to be severed during the next revolution of bedroll 11; the output pulse generated by the bedroll sensor 22 indicating that the bedroll 11 is at a known angular position; the output of an oscillator 71 that generates a series of pulses wherein each pulse represents a known incremental angle of rotation of the roll 35*a*; and a NEW CYCLE signal applied to the line 73.

Before proceeding with the detailed description of the control apparatus of FIG. 2, the general principle of operation will be described. At the instant the web is severed, the length of the web from the tail to the tail tier is known. Also, since each pulse generated by oscillator 71 represents a known length of the web passing by the tail tier 60*a*, the precise number of oscillator 71 pulses that will occur after the web has been severed in order to position the tail of the web at the tier can be determined. Proceeding now with the detailed description of FIG. 2, the CUT signal indicates that the web 10 is about to be severed. When the bedroll index 21 rotates past the bedroll sensor 22, the bedroll sensor 22 generates a pulse indicating a known angular position of the bedroll 11. This pulse also indicates where the severed end of the web is, or will be, because the cutting blade 15 is mechanically actuated by the bedroll 11 when the bedroll is at a predetermined angle.

The operator uses the thumbwheel switches 76 to establish a predetermined number of pulses to be counted by the counter 78. A digital representation of the predetermined number appears at the output 77 of the thumbwheel switches and is applied to the preset inputs of the counter 78. When the NEW CYCLE signal appears at the PRESET control input of counter 78, the predetermined number is transferred into the counter 78. The CUT signal is applied to one input of AND-gate 79 and the pulses generated by bedroll sensor 22 is applied to the other input of AND-gate 79. The output of AND-gate 79 is applied to the START control input of counter 78 and enables counter 78 to begin counting downward. Upon the occurrence of a pulse generated by the oscillator 71, the number in the counter 78 will be decremented by one count. When the counter reaches zero, the brake 56*a* will be activated to prevent any further rotation of mandrel 33*a*. After the roll 35*a* has stopped rotating, the tail tier 60*a* will be activated to secure the end of the roll to the roll. Thus, the operator by controlling the number dialed into the thumbwheel switches 76 can control the location of the end 47*a* of the web with respect to the tail tier 60*a*. In actual practice it is customary to have the end 47*a* of the web project beyond the tier 60*a* to leave a small portion of the end of the web 46*a*, commonly referred to as the handle, unsecured to the roll.

The prior discussion of the operation of the apparatus depicted in FIG. 2 assumed that the brake 56*a* instantaneously stopped the rotation of roll 35*a*. It is well known that there is a small delay from the time the brake means 56*a* is activated to the instant that the mandrel 33*a* has stopped rotating. This time delay can be compensated for by the operator in the selection of the predetermined number that is dialed into the thumbwheel switches 76.

Although the CLOCK control input of counter 78 is shown as being driven by oscillator 71, it will be apparent to those skilled in the art that the pulses generated by either the bed roll encoder 25 or the winding encoder 44 as depicted in FIG. 1, could be used to drive the CLOCK control input of counter 78.

Thus, it can be seen that the apparatus of FIG. 2 controls the angular orientation of the roll 35*a* by using a counter 78 for counting a predetermined number of pulses generated by oscillator 71 after the occurrence of the signal generated by AND-gate 79 indicating that the web has been severed, and then braking the mandrel 33*a* thereby stopping the roll 35*a* so that the end 47*a* of the roll is located at a desired angle with respect to the tail tier 60*a*. In the embodiment just described the tail orienting function can be considered to be synchronous with the cutting operation because the brake is applied at a fixed, predetermined time after the cutting operation as determined by counter 78.

In certain paper roll processing applications it is desired to have the tail orienting operation occur asynchronously, or independently of the cutting operation. The tail orienting apparatus of FIG. 2 is not capable of operating independently of the cutting operation because once counter 78 counts down to zero, there is no longer any stored representation of the location of the tail with respect to a known reference.

Figure 3:
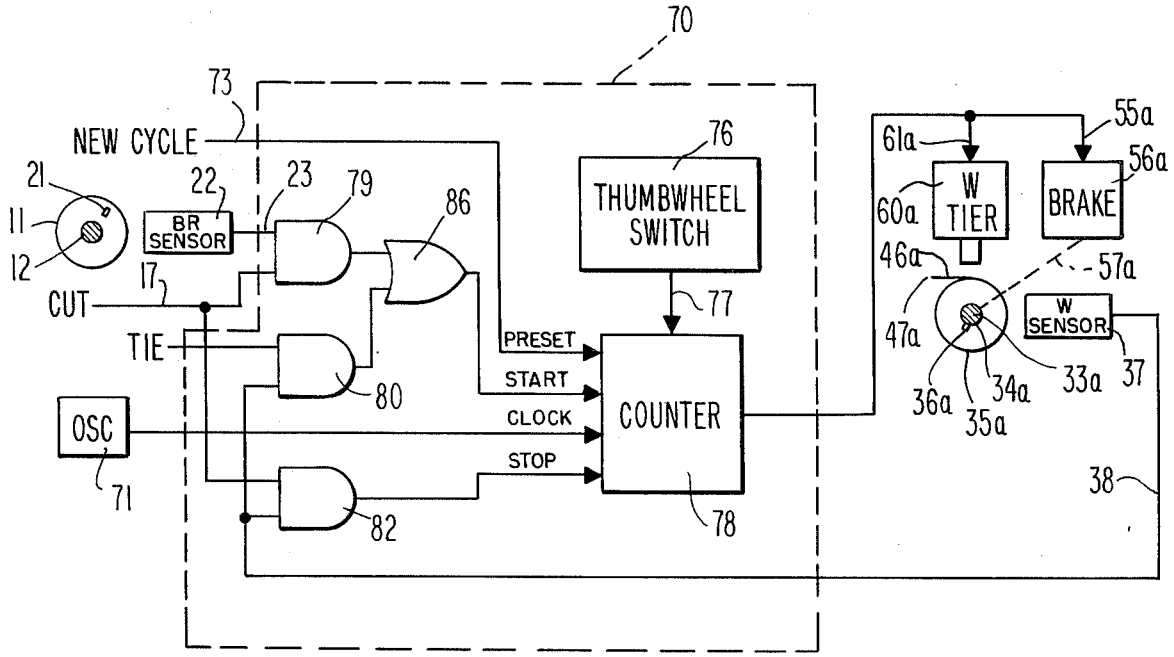
FIG. 3 is a block diagram of a second embodiment of the tail orienting control apparatus of this invention.

FIG. 3 illustrates how the control apparatus of FIG. 2 can be modified to accomplish the orienting of wound roll 35*a* at the winding station independently of the cutting of the web. The apparatus of FIG. 3 differs from that of FIG. 2 in that the winding sensor 37 detects the winding index 36*a* rotating in synchronism with winding mandrel 33*a* to provide an additional control signal for counter 78 and additional logic gates are provided to accomplish the slightly more complex control of counter 78.

Before proceeding with the detailed description of FIG. 3, the operating principle of the apparatus will be discussed. As in the apparatus depicted in FIG. 2, the operator can dial into thumbwheel switches 76 a predetermined number representing the total angular rotation that the mandrel 33*a* must undergo from the instant the web is severed in order to locate the tail 47*a* of the wound roll 35*a* at a desired angular position. The digital number appearing at the thumbwheel switches is transferred into counter 78 and, instead of counting the number in counter 78 down in a single interval, the number in the counter 78 is counted down in two separate intervals. The first interval occurs between the occurrence of the signal indicating that the web has been severed and the instant when the index sensor 37 generates a pulse signifying that the roll 35*a* is at a known angular position. The counter 78 is then stopped. The number remaining in counter 78 represents the additional angular rotation of mandrel 33*a* to locate the tail 47*a* of the roll at the desired angular position referenced to the alignment of index 36*a* with index sensor 37. When it is later desired to complete the orienting of the wound roll 35*a*, the next pulse generated by the index sensor 37 will allow the counter 78 to resume counting downward. When the number in the counter 78 becomes zero, the tail 47*a* of the roll will be at the desired angular position of the roll.

As for the detailed operation of the control apparatus of FIG. 3, the counter 78 has a STOP control input that is driven by the output of logic AND-gate 82. The CUT signal, indicating that the cutting operation is taking place, is applied to one input of AND-gate 82 and the pulses generated by the winding index sensor 37 is applied to the other input of AND-gate 82. The starting of counter 78 is controlled by AND-gates 79, 80 and OR-gate 86. The CUT signal is applied to one input of AND-gate 79 and the pulses generated by the bedroll sensor 22 are applied to the other input of AND-gate 79. The output of AND-gate 79 is applied to the START control input of counter 78 through OR-gate 86. The TIE signal, indicating that the orienting of the roll 35*a* is to be completed, is applied to one input of AND-gate 80 and the pulses generated by the winding index sensor 37 are applied to the other input of AND-gate 80. The output of AND-gate 80 is applied to the START control input of counter 78 through the other input of OR-gate 86.

In operation, the operator dials on the thumbwheel switches 76 the predetermined number representative of the desired angular orientation of the tail 47*a* of the roll 35*a.* When a NEW cycle signal appears at the PRESET control input of counter 78, the digital representation of the number dialed into thumbwheel switches 76 is transferred into the counter 78. After the CUT signal appears, the next pulse generated by the bedroll index sensor 22 will cause the output of AND-gate 79 to go to the logic 1 state which, in turn, causes the output of OR-gate 86 to go to the logic 1 state thereby enabling counter 78 to begin counting downward. Since the CUT signal is also applied to one input of AND-gate 82, the next pulse generated by the winding index sensor 37 will cause the output of AND-gate 82 to go to the logic 1 state which will stop counter 78. The number that remains in the counter 78 represents the angular rotation of the mandrel 33*a* in order to locate the tail 47*a* of the roll at the desired angular position referenced from the alignment of the winding index 36*a* with the winding sensor 37. At some later time, which may or may not be in synchronism with the CUT signal, the TIE signal, acting as an orient command signal, is applied to one input of AND-gate 80. When the next pulse generated by winding index sensor 37 occurs, the output of AND-gate 80 will go to the logic 1 state and will be applied to the START control input of counter 78 through OR-gate 86, thereby enabling counter 78 to resume counting downward. When the number in counter 78 because zero, the brake 56*a* is activated to prevent further rotation of the mandrel 33*a,* and the tail tier 60*a* is activated to secure the tail of the web to the roll. As with the apparatus of FIG. 2, the operator can select the number dialed into the thumbwheel switches 76 to provide for a desired handle length 46*a* and to compensate for system delays such as the brake delay.

Figure 4:
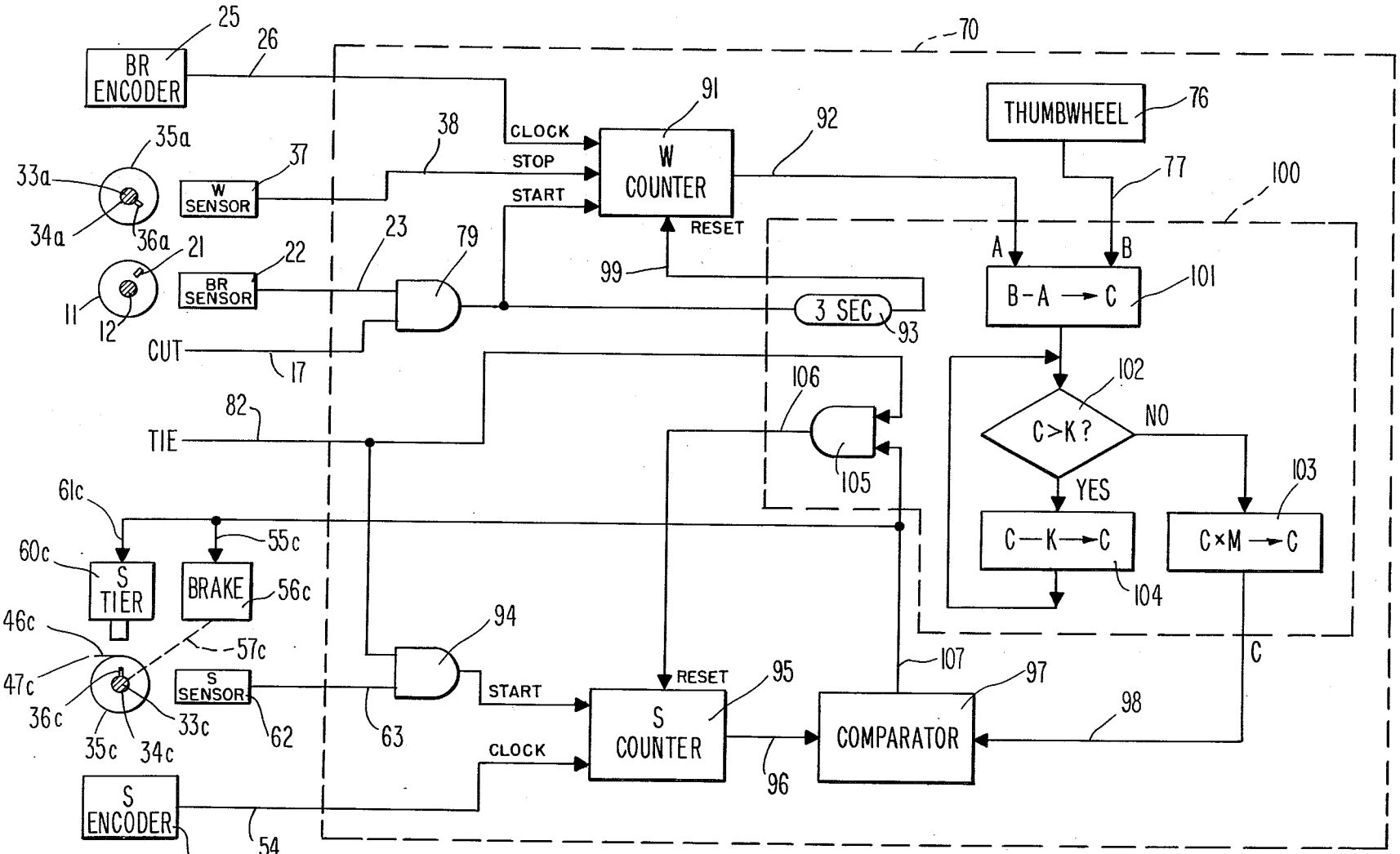
FIG. 4 is a block diagram of a third embodiment of the tail orienting control apparatus of this invention.

The previously described principles can be further applied to a tail orienting apparatus, as illustrated in the embodiment of FIG. 4 wherein the winding is performed at one station and the orienting of the roll is accomplished at another station which could, for example, be a stripping station. The control apparatus of FIG. 4 uses most of the elements of the control apparatus of FIG. 3, but further requires a stripping sensor 62 to detect the stripping index 36*c* rotating in synchronism with the mandrel 33*c* at the stripping station and a stripping encoder 52 rotating in synchronism with mandrel 33*c* for generating a series of pulses wherein each pulse represents a known incremental length of the web wound onto the roll 35*c.* Furthermore, since wound rolls 35*a,* 35*c* are being processed simultaneously at the stripping station and at the winding station, it has been found desirable to employ two control counters, a first control counter 91 associated with the winding station and a second control counter 95 associated with the stripping station. It should be clear to those skilled in the art that the system could be designed so that the counting associated with the winding station does not occur at the same time as the counting associated with the stripping station, in which case a single counter can be used.

A general description of the operation of the embodiment of FIG. 4 now follows. The operator sets in a predetermined number, representative of the desired angular position of the tail 47*c,* into thumbwheel switches 76 and the predetermined number is counted in two separate intervals. The winding counter 91 counts the number of oscillator, or bedroll encoder 25, pulses that are generated between the occurrence of the severing of the web and a known angular position of mandrel 33*a,* as indicated by the alignment of mandrel index 36*a* with the winding sensor 37. The number counted by the winding counter 91 is subtracted from the number established by the operator in thumbwheel switches 76 to form a second control number for the stripping counter 95. When the wound roll is advanced to the stripping station, the stripping counter 95 counts the number of pulses generated by an oscillator, or stripping encoder 52, that occur after the stripping index 36*c* is in alignment with the stripping sensor 62. When the number in the stripping counter 95 equals the second control number, brake means 56*c* is activated to prevent further rotation of the roll 35*c* and the tail tier 60*c* can be activated to secure the tail 47*c* of the roll to the roll.

A detailed description of the operation of the embodiment of FIG. 4 now follows. The bedroll encoder 25 generates at its output 26 a plurality of pulses wherein each pulse represents an incremental angle of rotation of the bedroll 11. The bedroll encoder 25 pulses are applied to the CLOCK control input of winding counter 91. As described previously in the description FIG. 2, the output of AND-gate 79, indicating that the web has been severed, is applied to the START control input of winding counter 91. The STOP control input of winding counter 91 is driven by the pulses generated by winding sensor 37. The output of AND-gate 79 is also applied to a three second delay circuit 93 that is a part of control circuit 100. The output of the three second delay circuit is applied to the RESET control input of winding counter 91. The digital number output 92 of winding counter 91 is applied to an input, designated A, of control circuit 100. The digital number output 77 of the number set into thumbwheel switches 76 by the operator is applied to an input, designated B, of control circuit 100. The control circuit 100 operates on the digital number appearing at the A input and the digital number appearing at the B input to generate a second digital control number at the output, designated C, and represented as a single line 98. The operations performed on the digital numbers appearing at inputs A and B are depicted in terms of a flow diagram consisting of blocks 101, 102, 103 and 104. As indicated by block 101 control circuit 100 subtracts the digital number appearing at input A from the digital number appearing at input B and stores the result in a register, designated as C, and then proceeds to perform the operation designated in block 102. Block 102 provides for the comparison of the number stored in register C to a constant, K, and if C is greater than K, the control circuit 100 will perform the operation represented by block 104. Block 104 causes the number K to be subtracted from the number stored in register C, stores the result in register C and then proceeds back to again attempt to perform the operation represented in block 102. If the result of the comparison block 102 is that the number K is less than or equal to the number stored in register C, the operation represented by block 103 will be performed by control circuit 100. Block 103 multiplies the number stored in register C by a constant, M, and stores the result in register C. The digital number that is stored in register C as a result of the performance of block 103 appears at the output, C, of control circuit 100 and is applied to an input 98 of a digital number comparator 97. The pulses generated by the stripping encoder 52 are applied to the CLOCK control input of stripping counter 95. A control signal, designated TIE, appears at line 82 and is applied to one input of AND-gate 94. The TIE signal indicates that it is desired to complete the angular orientation of the wound roll 35*c* at the stripping station. The output of stripping sensor 62 is applied to the other input of AND-gate 94. The output of AND-gate 94 drives the START control input of stripping counter 95. The digital number output 96 of the stripping counter 95 is applied to a second input of comparator 97. The output of comparator 97, appearing at line 107, activates the brake means 56*c* and the tail tier 60*c.* The output of comparator 97 is also combined with the TIE signal by means of AND-gate 105 to provide at its output 106 a control signal that is applied to the RESET control input of the stripping counter 95.

In operation, it is initially assumed that the winding counter 91 and the stripping counter 95 have both been reset and therefore, contain therein the number zero. When the CUT signal is present, the next pulse generated by the bedroll sensor 22 will cause the output of AND-gate 79 to go to the logic 1 state which enables the winding counter 91 to begin counting upward. The next pulse generated by the winding sensor 37, indicating that the index 36*a* is in alignment with winding sensor 37, stops winding counter 91. The number stored in winding counter 91 is applied to the A input of control circuit 100. The control circuit 100 then subtracts the digital number generated by winding counter 91, and appearing at input A, from the digital number dialed into the thumbwheel switches 76, and appearing at input B, and then stores the result in a register C as represented by block 101. The control circuit 100 then takes the number stored in register C and compares it to a constant, K, and, if the number stored in register C is greater than K proceeds to subtract K from the number stored in register C and then stores the result of the subtraction in register C, as indicated by blocks 102 and 104. The reason for performing the operations represented by blocks 102 and 104 is that the number that results when A is subtracted from B can represent more than one complete revolution of the roll 35*c.* Thus, the number stored in register C is compared to the number K, representing 360° of rotation of the roll 35*c,* and if the number stored in C is greater than K the number K is subtracted from the number stored in register C. Although this step is not necessary because the roll 35*c* continues to rotate as it advances to the stripping station, the system accuracy and performance is improved by reducing the amount of time the stripping counter 95 is required to count. Once the number stored in register C has been reduced by subtracting out any integral numbers of revolution of the roll 35*c,* the number in register C is multiplied by a constant, M, and the result stored in register C. The purpose of the operation represented by block 103 is to compensate for the difference, if any, of the incremental length of web represented by one stripping encoder 52 pulse as compared to the incremental length of web represented by one bedroll encoder 25 pulse. The constant, M, can also be changed to compensate for long term changes of the stripping drive means 50 characteristics. When the roll advances to the stripping station, the TIE signal will appear at one input to AND-gate 94 to indicate that it is desired to orient the roll in preparation for the tail tieing operation. The next pulse generated by stripping sensor 62, indicating that the index 36*c* is in alignment with stripping sensor 62, is applied to the other input of AND-gate 94 thereby causing the output of AND-gate 94 to go to the logic 1 state which enables the stripping counter 95 to begin counting upward. The digital number in the strip counter 95 is applied to the other input of comparator 97. When the number in the strip counter 95 equals the number appearing at the C output of control circuit 100, the output of comparator 97, which appears at line 107, will activate the brake means 56*c* and stop the rotation of the roll 35*c.* When the roll has stopped rotating the tail tier 60*c* will operate to secure the tail of the roll to the roll. The output of comparator 97 is also applied to one input of AND-gate 105 and the TIE signal is applied to the other input of gate 105. The output of AND-gate 105 resets counter 95 to zero. The output of AND-gate 79 is applied to a three second delay circuit 93, and the output of the delay circuit 93 resets the winding counter 91 to zero. The three second delay is sufficient to accomplish the starting and stopping of the winding counter 91 and the combination of the number generated by the winding counter 91 with the number in the thumbwheel switches 76 to formulate the second control number for the stripping counter 95 that is stored in register C.

In the description of FIG. 4 reference has been made to a single storage register, C, for storing a second control number for stripping counter 95. It will be appreciated by those skilled in the art that if the stripping station is located two turret index positions from the winding station it will be necessary for control circuit 100 to include at least one buffer register for storing the second control number for the wound roll that is approaching the stripping station.

The following description of FIG. 5 may also help to understand the principle of operation of our invention. In accordance with the embodiment of FIG. 2, at the instant of cutting, the length of web from the tail 47*a* of the web to a spot on the roll adjacent to winding sensor 37 is known and is designated $L_W$. The length of web on the surface of the roll from a point adjacent the winding sensor 37 to a point adjacent the tail tier 60 is also known and designated $L_T$. If, as shown in FIG. 5B, it is desired that the tail of the web be tied so that a short portion, designated $L_H$, extends beyond the tier 60, then the length of web that is to be wound onto the roll after the instant of cutting is represented by dotted line 111 and is equal to $L_W$ minus $L_T$ minus $L_H$, which can be converted into a number of pulses to be counted by counter 78 of FIG. 2.

Figure 5A:
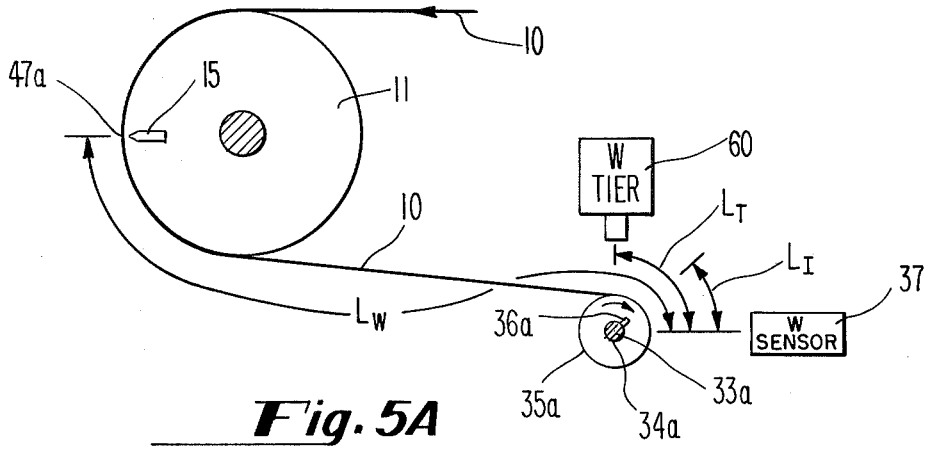
FIG. 5 shows the relationship of the end of the web at the instant of cutting with respect to the winding station sensor and the location of the end of the web after cutting with respect to the winding station sensor and the stripping station sensor when the roll is at a known angle.
Figure 5B:
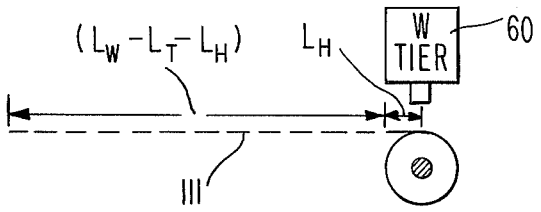
Figure 5C:
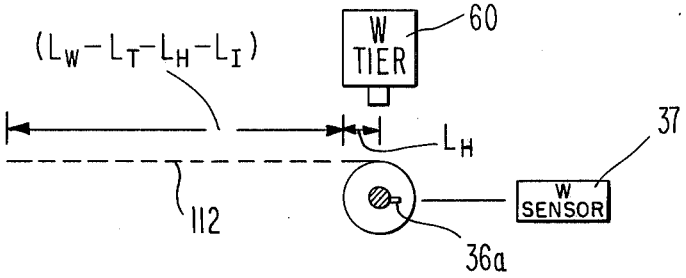

The embodiment of FIG. 3 initially only counts down the number of pulses representing the length of web, designated $L_I$ in FIG. 5A, that passes by winding sensor 37 from the instant of cutting until the winding index 36*a* is aligned with the winding sensor 37. The number remaining in counter 78 continues to represent the additional length of web that must be wound onto the roll in order to position the tail at the desired angle as referenced from the alignment of the winding index 36*a* with the winding sensor 37. This additional length is shown as dotted line 112 in FIG. 5C and is equal to $L_W$ minus $L_T$ minus $L_H$ minus $L_I$.

Figure 5D:
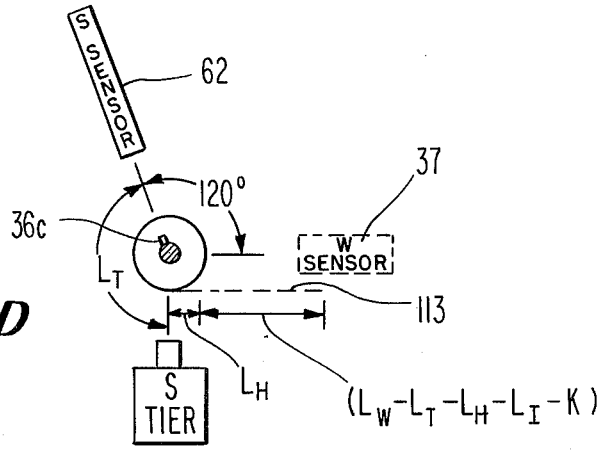

FIG. 5D shows the principle of operation of the embodiment of FIG. 4. The stripping sensor 62 is located 120° in a counterclockwise direction from the orientation of the winding sensor 37, shown as a dotted block in FIG. 5D. This 120° of rotation is equal to the 120° of rotation of the turret 31 as the roll progressed from the winding station to the stripping station. In discussing FIG. 4 it was pointed out that if the number that controls the stripping counter 95 represents a distance greater than the circumference of the roll, the value of the circumference of the roll will be continually subtracted from the control number until the control number is less than 1 circumference of the roll. Thus, the length of web to be counted by the stripping counter 95 is represented by dotted line 113 as $L_W$ minus $L_T$ minus $L_H$ minus $L_I$ minus K where K represents an integral number times the circumference of the roll.

Since our orienting apparatus does not use photoelectric means, it is not as sensitive to the accumulation of fibers on the apparatus. Furthermore, since digital processing techniques are employed, the described embodiments are believed to be considerably more accurate than prior art tail orienting devices. The operator control is simple yet flexible. By dialing in a control number at the thumbwheel switches 76, the operator can adjust the handle length, can compensate for long term drifts of system parameters such as the brake reaction time, or can compensate for the location of the stripping station sensor 62 with respect to the location of the winding station sensor 37.

In the embodiments heretofore described, several elements have been described in terms of the function they perform and it will be apparent to one skilled in the digital arts that many components are available in the marketplace that can perform those functions. In one embodiment of our invention, the control circuit 100 is a Programmable Controller, Model 184–4, manufactured by Modicon Corporation, Andover, Massachusetts; encoder 52 is a tachometer manufactured by Dynapar Corporation, Gurnee, Illinois; counter 91 is a Model 8120 counter and comparator 97 is a model 684 comparator both manufactured by United Systems Corporation, Dayton, Ohio.

Although the various embodiments have been described as operating a brake 56 and a tail tier 60, it will be apparent to those skilled in the art that our apparatus is generally useful in paper roll processing operations wherein it is desired to keep track of the angular orientation of the end of the roll. Although the previously described embodiments have been described as activating the tail tier 60, it is contemplated that our control apparatus operate with the tail tier described in U.S. Pat. No. 3,935,057, issued to Robert D. Gray and assigned to the assignee of the present invention, which does not need to be activated by the tail orienting apparatus because the tail tieing operation is performed automatically as the roll 35 is stripped from the mandrel 33.

While the present invention has been described with reference to specific embodiments thereof it will be obvious to those skilled in the art that various changes and modifications may be made without departing from the invention in its broader aspects. For example, although one embodiment of FIG. 4 utilizes a programmable controller to perform the functions of control circuit 100, it will be apparent to those skilled in the art that certain programmable controllers or microprocessors may be capable of additionally performing some of the other functions within control block 70.

What is claimed as new and desired to be secured by Letters Patent of the United States is:

1. In a system for cutting a desired length of a web being wound in a roll, an apparatus for orienting the free end of the roll at a predetermined angle, said orienting occurring in synchronism with the cutting, comprising:

a. first means for generating a signal representative of the cutting of the web;

b. second means for generating a series of pulses, each pulse representing an incremental length of the web being wound on the roll;

c. third means for generating a number representing a predetermined number of pulses generated by the second means; and d. circuit means including a counter responsive to the first means signal, the second means pulses and to said predetermined number for generating a signal indicating that said predetermined number of pulses have been generated by the second means since the occurrence of the signal generated by the first means, said circuit means signal indicating that the free end of the roll is at the predetermined angle.

2. An apparatus as recited in claim 1 wherein the second means is an oscillator.

3. An apparatus as recited in claim 1 wherein the second means is an encoder rotating in synchronism with the roll.

4. An apparatus as recited in claim 1 wherein the system includes means for rotatably driving the roll and wherein the second means is an encoder driven by the roll driving means.

5. An apparatus as recited in claim 1 wherein the system includes a bedroll over which the web is wound onto the core, and bedroll drive means, and wherein the second means is an encoder driven by the bedroll drive means.

6. An apparatus as recited in claim 1 wherein the third means is a plurality of thumbwheel switches.

7. An apparatus as recited in claim 1 further comprising means responsive to the signal generated by the circuit means for securing the free end of the web to the wound roll.

8. An apparatus as recited in claim 1 further comprising means responsive to the signal generated by the circuit means for stopping the rotation of the roll.

9. In a system for cutting a desired length of a web being wound in a roll, an apparatus for orienting the free end of the roll at a predetermined angle, said orienting occurring asynchronously with the cutting, comprising:

a. first means for generating a signal representative of the cutting of the web;

b. second means for generating a series of pulses, each pulse representing an incremental length of the web being wound on the roll;

c. sensor means, responsive to an index rotating synchronously with the roll, for generating a signal representing a predetermined angular position of the roll;

d. third means for generating a number representing a predetermined number of pulses to be counted; and e. circuit means including a counter responsive to the first means signal, the second means pulses, the sensor signal, the predetermined number and to an orient command signal, said counter counting the number of pulses generated by the second means between the occurrence of the first means signal and the occurrence of the sensor means signal and then counting the number of pulses generated by the second means after the occurrence of the orient command signal, said circuit means generating a signal when said predetermined number of pulses have been counted, indicating that the free end of the roll is at the predetermined angle.

10. An apparatus as recited in claim 9 wherein the second means is an oscillator.

11. An apparatus as recited in claim 9 wherein the second means is an encoder rotating in synchronism with the roll.

12. An apparatus as recited in claim 9 wherein the system includes means for rotatably driving the roll and wherein the second means is an encoder driven by the roll driving means.

13. An apparatus as recited in claim 9 wherein the system includes a bedroll over which the web is wound onto the roll, and bedroll drive means, and wherein the second means is an encoder driven by the bedroll drive means.

14. An apparatus as recited in claim 9 wherein the third means is a plurality of thumbwheel switches.

15. An apparatus as recited in claim 9 further comprising means responsive to the signal generated by the circuit means for securing the free end of the web to the wound roll.

16. An apparatus as recited in claim 9 further comprising means responsive to the signal generated by the circuit means for stopping the rotation of the roll.

17. In a system for cutting a desired length of a web being wound in a roll, an apparatus for orienting the free end of the roll at a predetermined angle, said orienting occurring asynchronously with the cutting, comprising:

a. first means for generating a signal representative of the cutting of the web;

b. second means for generating a series of pulses, each pulse representing an incremental length of the web being wound on the roll;

c. sensor means, responsive to an index rotating synchronously with the core, for generating a signal indicating a predetermined angular position of the roll;

d. third means for generating a series of pulses, each pulse representing an incremental length of the web at the surface of the roll rotating past the sensor means;

e. fourth means for generating a number representing a predetermined number of pulses to be counted; and f. circuit means including a counter responsive to the first means signal, the second means pulse, the sensor signal, the third means pulses, the predetermined number and to an orient command signal, said counter counting the number of pulses generated by the second means between the occurrence of the first means signal and the occurrence of the sensor signal and then counting the number of pulses generated by the third means after the occurrence of the orient command signal, said circuit means generating a signal when said predetermined number of pulses have been counted, indicating that the free end of the roll is at the predetermined angle.

18. An apparatus as recited in claim 17 wherein the second means is an oscillator.

19. An apparatus as recited in claim 17 wherein the second means is an encoder rotating in synchronism with the roll.

20. An apparatus as recited in claim 17 wherein the system includes means for rotatably driving the roll and wherein the second means is an encoder driven by the roll driving means.

21. An apparatus as recited in claim 17 wherein the system includes a bedroll over which the web is wound onto the roll, and bedroll drive means, and wherein the second means is an encoder driven by the bedroll drive means.

22. An apparatus as recited in claim 17 wherein the third means is an oscillator.

23. An apparatus as recited in claim 17 wherein the third means is an encoder rotating in synchronism with the roll.

24. An apparatus as recited in claim 17 wherein the system includes means for rotatably driving the roll and wherein the third means is an encoder driven by the roll driving means.

25. An apparatus as recited in claim 17 wherein the third means is a plurality of thumbwheel switches.

26. An apparatus as recited in claim 17 further comprising means responsive to the signal generated by the circuit means for securing the free end of the web to the wound roll.

27. An apparatus as recited in claim 17 further comprising means responsive to the signal generated by the circuit means for stopping the rotation of the roll.

28. In a system for cutting a desired length of a web being wound in a roll at a first station and then advancing the roll to a second station, an apparatus for orienting the free end of the web at a predetermined angle when the roll is at said second station, comprising:

a. first means for generating a signal representative of the cutting of the web;

b. second means for generating a series of pulses, each pulse representing an incremental length of the web being wound on the roll at the first station;

c. first sensor means, responsive to an index rotating in synchronism with the core, for generating a signal indicating a predetermined angular position of the roll at the first station;

d. sensor means, located at the second station, responsive to the index for generating a signal indicating a predetermined angular position of the roll at the second station;

e. third means for generating a series of pulses, each pulse representing an incremental length of the web at the surface of the roll rotating past the second station sensor;

f. fourth means for generating a number representing a predetermined number of pulses to be counted; and g. circuit means responsive to the first means signal, the second means pulses, the first station sensor signal, the second station sensor signal, the third means pulses, the predetermined number and to an orient command signal, said circuit means first counting the number of pulses generated by the second means between the occurrence of the first means signal and the occurrence of the first station sensor signal and then, in response to the orient command signal, counting the number of pulses generated by the third means after the occurrence of the second station sensor signal, said circuit means generating a signal indicating that the total number of pulses counted during the first and subsequent counting periods equal the predetermined number, said circuit means signal indicating that the free end of the roll is at the predetermined angle at the second station.

29. An apparatus as recited in claim 28 wherein the circuit means comprises a programable controller.

30. An apparatus as recited in claim 28 wherein the circuit means comprises:

a. a first counter responsive to the first means signal, the second means pulses and the first station sensor signal for counting the number of pulses generated by the second means between the occurrence of the first means signal and the occurrence of the first station sensor signal;

b. a programable controller responsive to the number generated in the first counter and to the number generated by the fourth means for generating a number of pulses to be counted in a second counter;

c. a second counter responsive to the orient command signal, the second station sensor signal and the third means pulses for counting pulses generated by the third means after the occurrence of both the orient command signal and the second station sensor signal; and d. a digital comparator, responsive to the number generated in the second counter and to the number generated by the programable controller, for generating the signal indicating that the predetermined number of pulses have been counted.

31. In a system for cutting a desired length of a web being wound in a roll at a winding station and then advancing the roll to a stripping station, an apparatus for orienting the free end of the roll at a predetermined angle when the roll is at the stripping station, comprising:

a. first means for generating a signal representative of the cutting of the web;

b. second means for generating a series of pulses, each pulse representing an incremental length of the web being wound on the roll at the winding station;

c. sensor means, located at the winding station, responsive to an index rotating synchronously with the roll, for generating a signal indicating a predetermined angular position of the roll at the winding station;

d. sensor means, located at the stripping station, responsive to the index for generating a signal indicating a predetermined angular position of the roll at the stripping station;

e. third means for generating a series of pulses, each pulse representing an incremental length of the web at the surface of the roll rotating past the stripping sensor;

f. fourth means for generating a first predetermined number;

g. a first counter responsive to the first means signal, the second means pulses and the winding sensor signal for counting the number of pulses generated by the second means between the occurrence of the first means signal and the occurrence of the winding sensor signal;

h. first circuit means responsive to the number in the first counter and to the first predetermined number for generating a second predetermined number of pulses to be counted;

i. a second counter responsive to an orient command signal, the stripping sensor signal and the third means pulses for counting the number of pulses generated by the third means after the occurrence of both the orient command signal and the stripping sensor signal; and j. second circuit means responsive to the number in the second counter and to the second predetermined number for generating a signal when the number of pulses counted by the second counter equals the second predetermined number, said second circuit means signal indicating that the free end of the roll is at the predetermined angle at the second station.

32. An apparatus as recited in claim 31 wherein the second means is an oscillator.

33. An apparatus as recited in claim 31 wherein the second means is an encoder rotating in synchronism with the roll.

34. An apparatus as recited in claim 31 wherein the system includes means for rotatably driving the roll at the winding station and wherein the second means is an encoder driven by the roll driving means at the winding station.

35. An apparatus as recited in claim 31 wherein the system includes a bedroll over which the web is wound onto the roll, and bedroll drive means, and wherein the second means is an encoder driven by the bedroll drive means.

36. An apparatus as recited in claim 31 wherein the third means is an oscillator.

37. An apparatus as recited in claim 31 wherein the system includes means for rotatably driving the core at the stripping station and wherein the third means is an encoder driven by the roll driving means at the stripping station.

38. An apparatus as recited in claim 31 wherein the fourth means is a plurality of thumbwheel switches.

39. An apparatus as recited in claim 31 wherein the first circuit means is a programable controller.

40. An apparatus as recited in claim 31 wherein the second circuit means is a digital number comparator.

41. An apparatus as recited in claim 31 further comprising means responsive to the second circuit means signal for securing the free end of the web to the wound roll.

42. An apparatus as recited in claim 31 further comprising means responsive to the signal generated by the circuit means for stopping the rotation of the roll.

43. An apparatus as recited in claim 42 wherein the system includes a bedroll over which the web is wound onto the roll, and bedroll drive means, and wherein the second means is a tachometer driven by the bedroll drive means.

44. An apparatus as recited in claim 43 wherein the system includes means for rotatably driving the roll at the stripping station and wherein the third means is a tachometer driven by the roll driving means at the stripping station.

45. An apparatus as recited in claim 44 wherein the fourth means is a plurality of thumbwheel switches.

46. An apparatus as recited in claim 45 wherein the first circuit means is a programable controller.

47. An apparatus as recited in claim 46 wherein the second circuit means is a digital number comparator.

48. An apparatus as recited in claim 47 further comprising means responsive to the second circuit means signal for securing the free end of the web to the wound roll.

* * * * *

UNITED STATES PATENT OFFICE

CERTIFICATE OF CORRECTION

Patent No. 4,038,127 Dated July 26, 1977

Inventor(s) Richard H. D. Bullock, Jr. et al

It is certified that error appears in the above-identified patent and that said Letters Patent are hereby corrected as shown below:

[75] Add Raymond H. Spooner, Jr. to list of inventors.
Rutledge, Pennsylvania

Signed and Sealed this

Sixth Day of December 1977

[SEAL]

*Attest:*

RUTH C. MASON
*Attesting Officer*

LUTRELLE F. PARKER
*Acting Commissioner of Patents and Trademarks*